US010912354B2

(12) United States Patent
Cabirou

(10) Patent No.: US 10,912,354 B2
(45) Date of Patent: Feb. 9, 2021

(54) JEWELLERY

(71) Applicant: AURA DESIGN, Paris (FR)

(72) Inventor: Marie Cabirou, Paris (FR)

(73) Assignee: AURA DESIGN, Paris (FR)

( * ) Notice: Subject to any disclaimer, the term of this patent is extended or adjusted under 35 U.S.C. 154(b) by 0 days.

(21) Appl. No.: 16/347,686

(22) PCT Filed: Nov. 7, 2016

(86) PCT No.: PCT/FR2016/052880

§ 371 (c)(1),
(2) Date: May 6, 2019

(87) PCT Pub. No.: WO2018/083388

PCT Pub. Date: May 11, 2018

(65) Prior Publication Data

US 2019/0254393 A1 Aug. 22, 2019

(51) Int. Cl.

| | |
|---|---|
| ***A44C 15/00*** | (2006.01) |
| ***A44C 1/00*** | (2006.01) |
| ***A44C 5/00*** | (2006.01) |
| ***A44C 7/00*** | (2006.01) |
| ***A44C 5/10*** | (2006.01) |
| ***A44C 17/02*** | (2006.01) |

(52) U.S. Cl.

CPC ..... *A44C 15/0025* (2013.01); *A44C 1/00* (2013.01); *A44C 5/102* (2013.01); *A44C 7/00* (2013.01); *A44C 15/005* (2013.01); *A44C 17/0266* (2013.01); *A44C 17/0275* (2013.01)

(58) Field of Classification Search

CPC ..... A44C 17/0258; A44C 17/0275; A44C 17/0266; A44C 15/0025; A44C 1/00; A44C 5/102; A44C 7/00; A44C 15/005; A44C 11/00; A44C 5/0053; A44C 5/0061; A44C 17/02

USPC ..... 63/21, 23, 31, 3, 4, 38; D11/8, 13, 79, D11/91, 92

See application file for complete search history.

(56) References Cited

U.S. PATENT DOCUMENTS

| | | | | |
|---|---|---|---|---|
| D516,934 | S * | 3/2006 | Carnegie | D11/56 |
| 9,408,442 | B1 * | 8/2016 | Terry | A44C 25/007 |
| 9,439,480 | B1 | 9/2016 | French | |

(Continued)

FOREIGN PATENT DOCUMENTS

| | | |
|---|---|---|
| CH | 634 475 A5 | 2/1983 |
| JP | 08-196313 A | 8/1996 |

OTHER PUBLICATIONS

International Search Report of PCT/FR2016/052880 dated Mar. 8, 2017.

(Continued)

*Primary Examiner* — Jack W Lavinder
(74) *Attorney, Agent, or Firm* — Sughrue Mion, PLLC

(57) ABSTRACT

Jewelry having a support base and a plurality of decorative elements, each having at least two different decorative zones, each decorative element being fastened in a frame that is secured to a connection member itself pivotally and/or rotatably mounted on the support base. Each decorative zone is oriented differently relative to the frame in such a manner that a different decorative zone is exposed depending on the position of each connection member on the support base, so as to modify the appearance of the jewelry.

15 Claims, 4 Drawing Sheets

(56) References Cited

U.S. PATENT DOCUMENTS

2009/0255295 A1* 10/2009 Lane ..... A44C 11/002
63/3.1
2012/0151963 A1* 6/2012 Dobashi ..... A44C 17/0258
63/26

OTHER PUBLICATIONS

International Preliminary Report on Patentability with English Translation of Written Opinion for PCT/FR2016/052880 dated May 7, 2019.

* cited by examiner

JEWELLERY

CROSS REFERENCE TO RELATED APPLICATIONS

This application is a National Stage of International Application No. PCT/FR2016/052880 filed Nov. 7, 2016.

The present invention relates to jewelry.

Jewelry is well known. It generally comprises a support base, such as a ring, an earring, a brooch, a bracelet, or a necklace, together with one or more decorative elements fastened to said base.

A drawback with existing jewelry lies in its non-modifiable appearance.

An object of the present invention is to provide jewelry that does not reproduce the above-mentioned drawbacks.

Another object of the present invention is to provide jewelry that makes it easy to modify the visual appearance of the jewelry.

Another object of the present invention is to provide such jewelry that is simple and/or inexpensive to fabricate and to assemble.

The present invention thus provides jewelry comprising a support base and a plurality of decorative elements, each having at least two different decorative zones, each decorative element being fastened in a frame that is secured to a connection member, itself pivotally and/or rotatably mounted on said support base, each decorative zone being oriented differently relative to said frame in such a manner that a different decorative zone is exposed depending on the position of each connection member on said support base, so as to modify the appearance of the jewelry.

Advantageously, each connection member has one end fastened to said frame and another end pivotally mounted on said support base to pivot about a pivot axis perpendicular to said connection member.

Advantageously, said connection member has two branches, each branch having a first end fastened to said frame and a second end pivotally mounted on a pin forming said pivot axis.

In an advantageous variant, each connection member is made in the form of two pin portions on a common axis arranged on either side of said frame, each pin portion firstly being fastened to said frame and secondly being mounted rotatably on said support base, in such a manner that said connection member forms the axis of rotation of said frame relative to said support base.

Advantageously, said axis of rotation is formed in a plane of symmetry of said frame.

Advantageously, said support base is rigid, such as a pin or a frame.

In a variant, said support base is deformable, such as a necklace or a bracelet.

Advantageously, said jewelry is an earring or a brooch, said support base forming an elongate pin having two attachment points, each attachment point being pivotally fastened on a respective end portion of said support base, thereby enabling the earring or the brooch to be attached in two opposite orientations depending on which attachment point is used.

Advantageously, each decorative element has two decorative zones formed by two mutually opposite faces at 180° relative to each other.

Advantageously, the decorative zones of each decorative element include decorative gems of different colors.

Advantageously, said decorative elements are in alignment one after another so that pivoting or rotating one of said decorative elements, in particular under gravity, gives rise to at least some of the other decorative elements pivoting or rotating.

Advantageously, said decorative elements are arranged along and around said support base, being pivotally mounted to pivot between a first longitudinal position in which the decorative elements are arranged in the direction of said support base and a second longitudinal position that is pivoted through 180° relative to said first longitudinal position, said decorative elements being capable of adopting any intermediate position between said first and second longitudinal positions.

These characteristics and advantages, and others, appear more clearly from the following detailed description made with reference to the accompanying drawings, which are given as non-limiting examples, and in which.

Figure 3A:
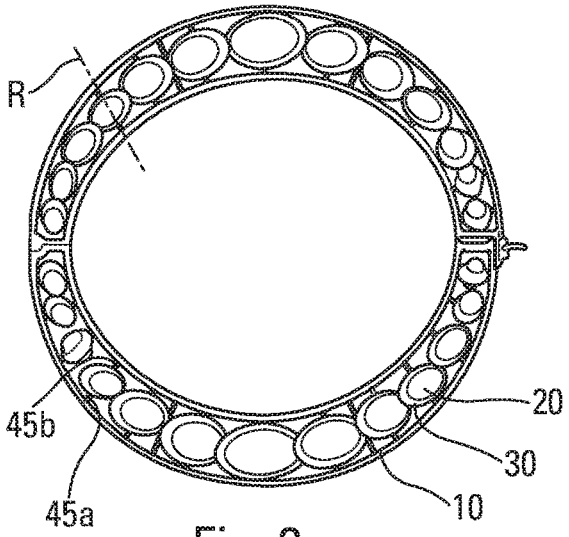
Figure 3B:
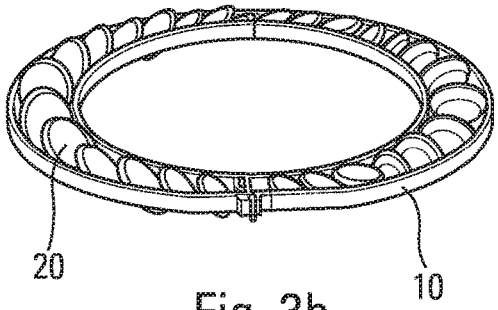
Figure 4A:
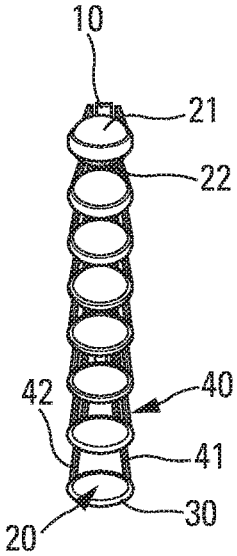
Figure 4B:
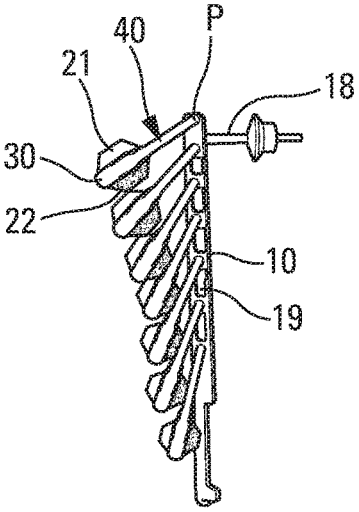
Figure 5:
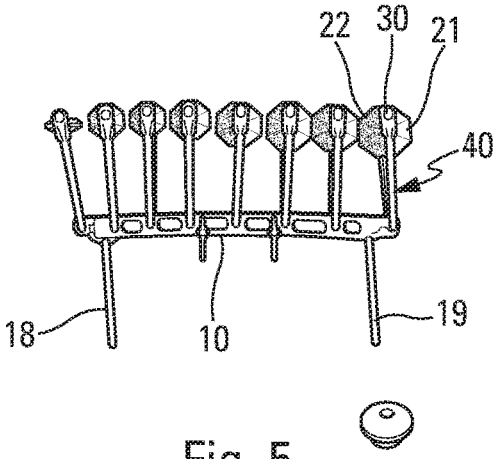

FIGS. 3*a* and 3*b* are perspective views from above and from the side of another piece of jewelry in an advantageous embodiment of the present invention, in the form of a bracelet;

FIGS. 4*a* and 4*b* are perspective views from above and from the side of another piece of jewelry in an advantageous embodiment of the present invention, in the form of an earring;

FIG. 5 is a perspective view from the side of a variant embodiment of the piece of jewelry shown in FIGS. 4*a* and 4*b;*

Figure 6:
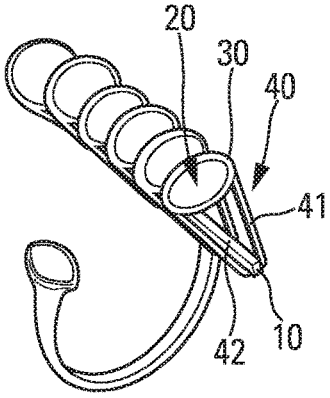
Figure 7A:
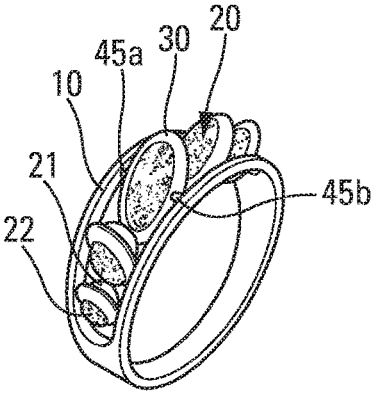
Figure 7B:
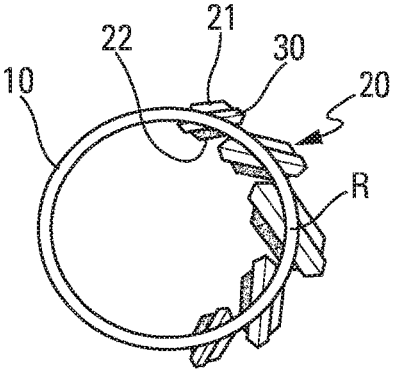
Figure 8A:
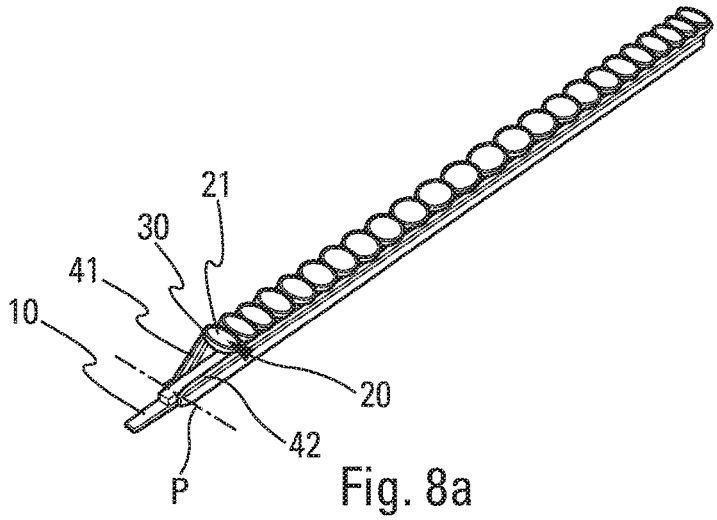
Figure 8B:
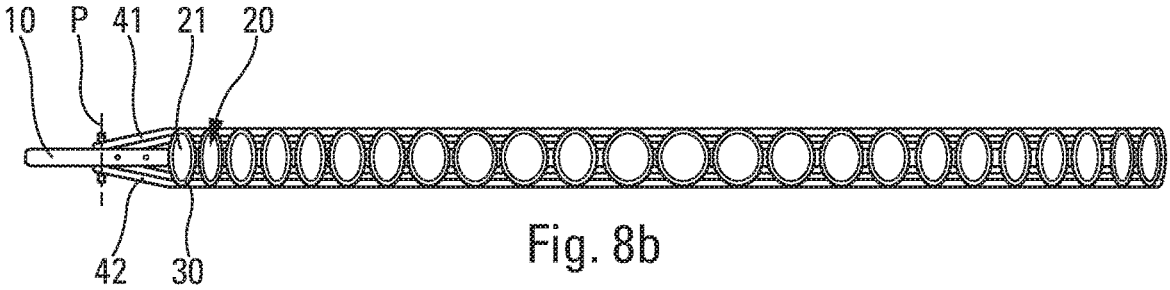
Figure 8C:
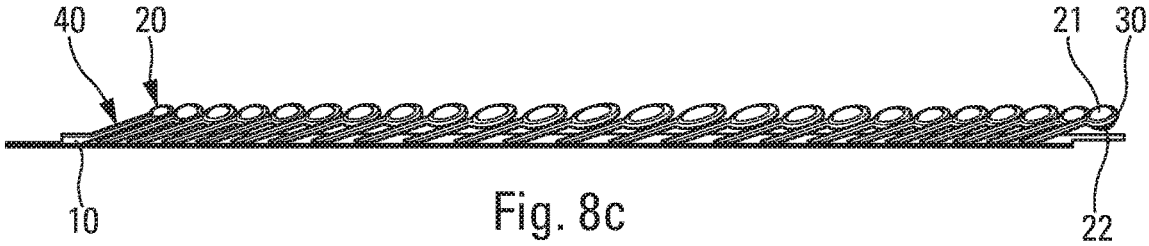
Figure 8D:
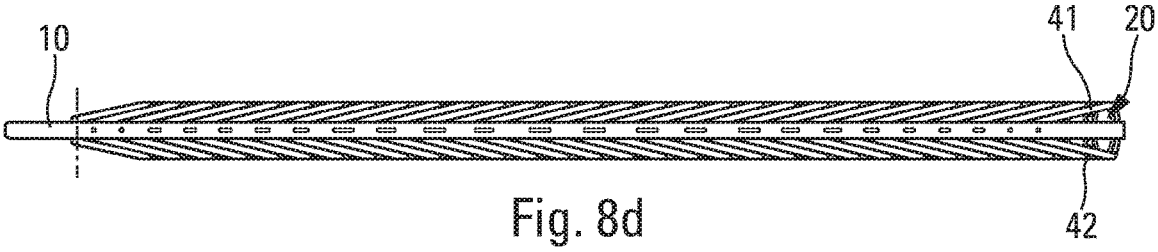
Figure 8E:
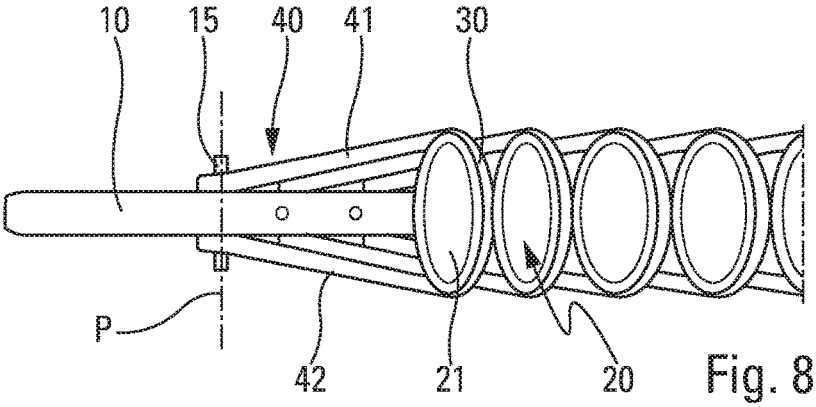
Figure 9A:
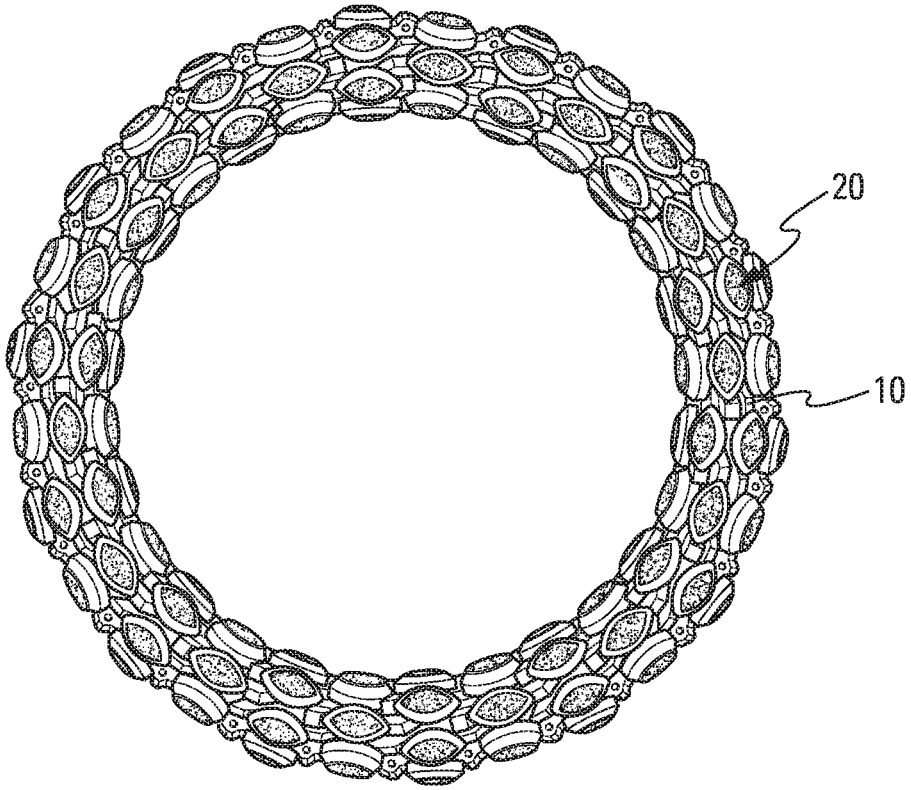
Figure 9B:
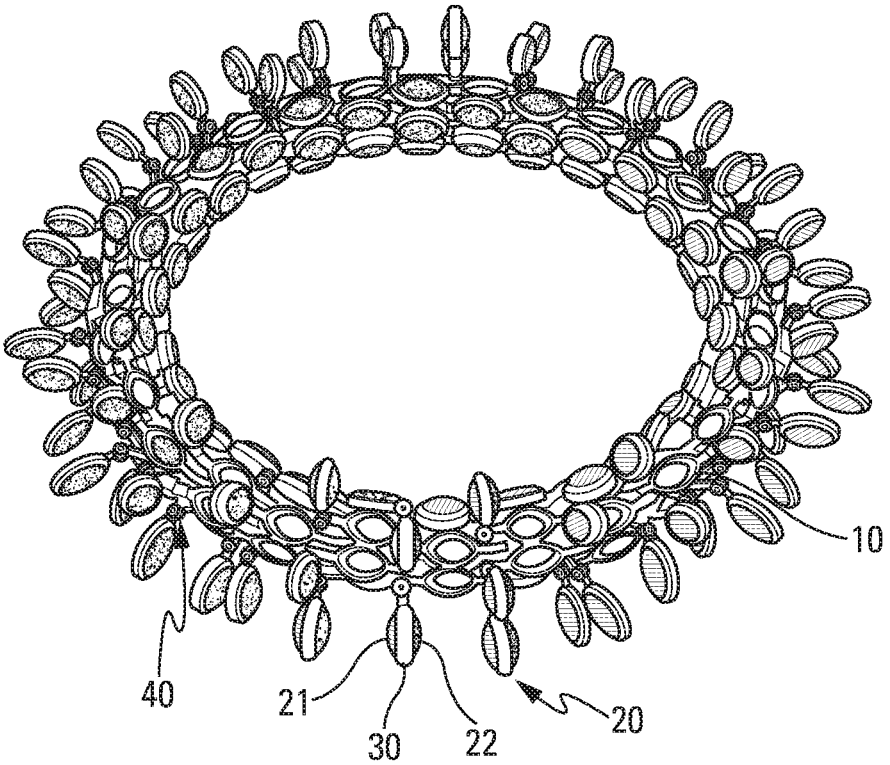

FIG. 6 is a perspective view of another piece of jewelry in an advantageous embodiment of the present invention, in the form of a ring;

FIGS. 7*a* and 7*b* are perspective views from the side and from above of yet another piece of jewelry in an advantageous embodiment of the present invention, in the form of a ring;

FIGS. 8*a* to 8*e* are perspective views from above, from the side, from below, and a detail view from above of the FIG. 1 bracelet; and FIGS. 9*a* and 9*b* are detail views in perspective from above of another piece of jewelry in an advantageous embodiment of the present invention, in the form of a bracelet or a necklace.

FIGS. 1 and 8*a* to 8*e* show a bracelet. It comprises a support base 10, in particular of the deformable type enabling the bracelet to be opened and fastened around a wrist. Typically such a support base may comprise a plurality of rigid links that are hinged relative to the links that are adjacent.

The support base 10 has a plurality of decorative elements 20, each comprising at least two decorative zones 21 and 22 having different orientations. In this example, each decorative element 20 comprises two decorative zones 21 and 22 that are formed on two mutually opposite faces that are at 180° relative to each other. Each decorative zone 21, 22 of each decorative element 20 advantageously includes decorative zones of different colors. In a variant, there could be any number of different decorative zones, oriented at any angles, and they could include any decoration, aspects, textures, or colors.

Each decorative element 20 is fastened in a frame 30 that is of oval or circular shape in the examples shown in the figures, but that could be of any shape.

Each frame 30 is fastened to a connection member that is pivotally mounted and/or rotatably mounted on said support base 10.

In the examples of FIGS. 1, 2, 4*a-b*, 5, 6, 8*a-e*, and 9*a-b*, each connection member 40 has one end that is fastened to said frame 30 and another end that is pivotally mounted on said support base 10 to pivot about a pivot axis P. The pivot axis P is preferably perpendicular to said connection member 40.

More particularly, and as can be seen in the examples of FIGS. 1, 2, 4*a-b*, 5, 6, and 8*a-e*, each connection member 40 may include two branches 41 and 42, each branch having a first end that is fastened to said frame 30 and a second end that is pivotally mounted, e.g. on a pin 15 forming said pivot axis P. Preferably, the two branches 41 and 42 are fastened to the frame 30 on two opposite sides of the frame so that said connection member 40 presents a general shape that is approximately triangular. Other shapes could naturally be envisaged.

In a variant, and as can be seen in FIGS. 3*a-b* and 7*a-b*, each connection member may be in the form of two pin portions 45*a* and 45*b* on a common axis that are arranged on either side of said frame 30. In this variant, each pin portion 45*a* and 45*b* is firstly fastened to said frame 30 and secondly it is mounted rotatably on said support base 10 in such a manner that said connection member 45*a*, 45*b* forms the axis of rotation R of said frame 30 relative to said support base 10. Advantageously, said axis of rotation R is formed in a central plane of symmetry of said frame 30.

Thus, in the invention, depending on the position of each connection member 40 or 45*a*, 45*b* on said support base 10, a different decorative zone of each decorative element 20 is exposed, thereby modifying the visual appearance of the jewelry.

Advantageously, the connection members 40 or 45*a*, 45*b* are caused to pivot or rotate by gravity, as a function of the orientation or the position of the jewelry. In a variant, provision may also be made for said connection members to be moved manually, possibly with blocking in one and/or the other of the positions, in order to maintain a given visual appearance for the jewelry, regardless of its orientation in three dimensions. Thus, in certain circumstances, the movement of the body and gravity enable the jewelry to transform continuously, and in other circumstances, it is possible to select the visual appearance desired for the jewelry when it is worn.

Figure 1:
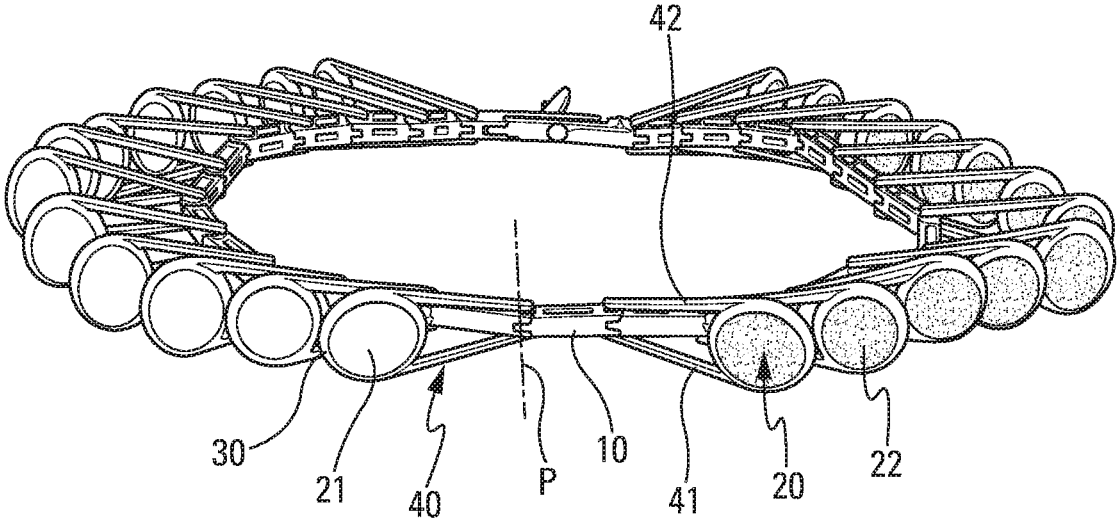
FIG. 1 is a perspective view of a piece of jewelry in an advantageous embodiment of the present invention, in the form of a bracelet.
Figure 2:
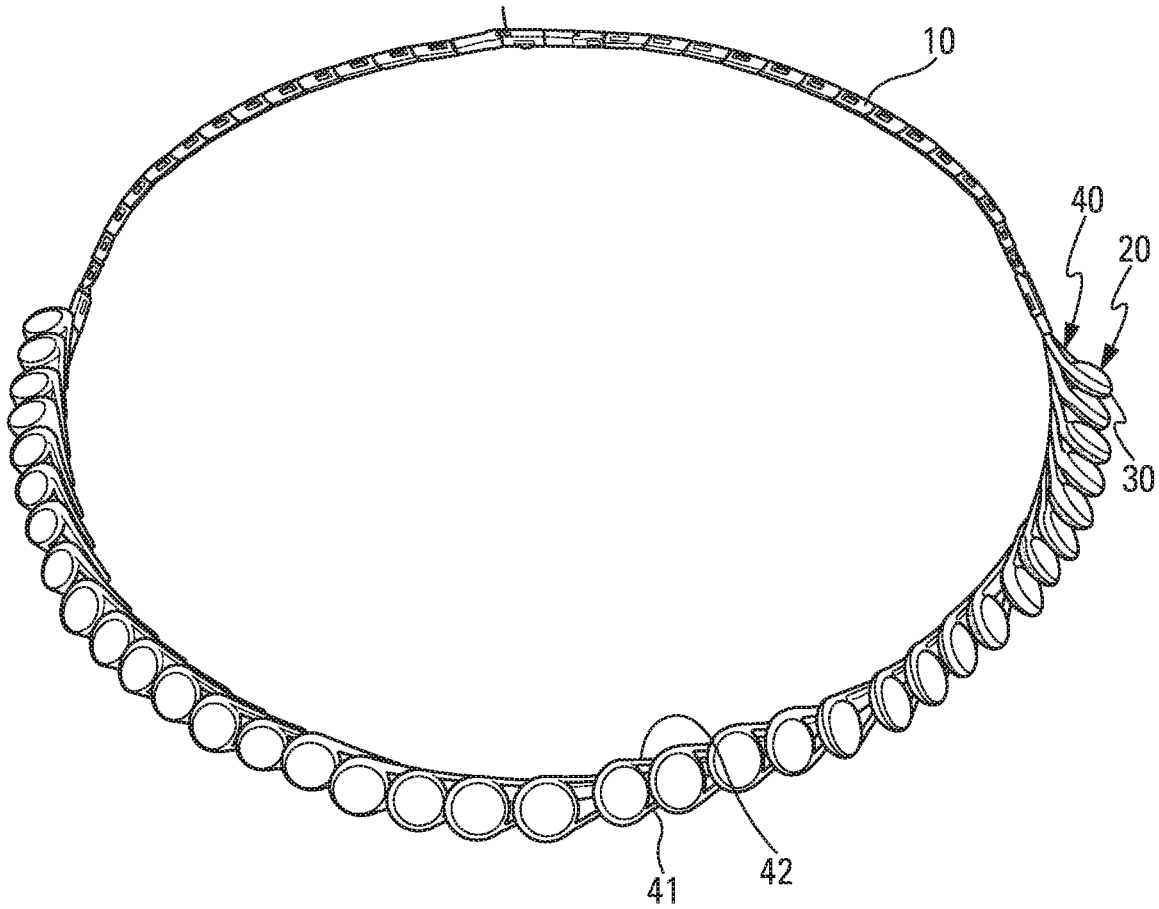
FIG. 2 is a view similar to FIG. 1, showing a piece of jewelry in an advantageous embodiment of the present invention, in the form of a necklace.

FIG. 2 shows a necklace comprising decorative elements 20 and connection members 40 similar to those of FIG. 1.

FIGS. 3*a* and 3*b* show a bracelet with a rigid support base 10 comprising two hinged-together portions to enable the bracelet to be opened and fastened on a wrist. The decorative elements 20 in this example are rotatably mounted on said two portions of the support base 10, as described above.

FIGS. 4*a*, 4*b*, and 5 show an earring. In this example, the support base 10 forms an elongate rigid pin having the connection members 40 pivotally mounted thereon. Advantageously, said support base has two attachment points 18 and 19, each attachment point being pivotally fastened to a respective end portion of said support base 10, thereby enabling the earring to be attached in two opposite orientations depending on which attachment point 18 or 19 is used. The point that is not in use is then folded in and fastened, e.g. snap-fastened, to the support base 10. The connection members 40 are advantageously caused to pivot by gravity, depending on the orientation that is selected for the earring. It should be observed that this configuration could be adapted for a brooch. Likewise, it is possible to envisage a support base that is not completely rigid.

FIG. 6 shows a ring provided with pivotal connection members 40, while FIGS. 7*a* and 7*b* show a ring with rotary connection members 45*a* and 45*b*.

Advantageously, the decorative elements 20 are in alignment one after another, such that pivoting or rotation of any one of said decorative elements leads to at least some of the other decorative elements 20 also being pivoted or rotated. This domino effect may be total, e.g. as for the earring in FIGS. 4*a-b* and 5, or the ring in FIG. 6, it may merely be partial, e.g. as for the bracelets of FIG. 1 or 3*a-b*.

FIGS. 9*a* and 9*b* show a bracelet or a necklace in which the decorative elements 20 are arranged not only along but also all around the support base 10. The connection members 40 are pivotally mounted to pivot between a first longitudinal position in which the decorative elements 20 are arranged in the direction of said support base 10, and a second longitudinal position after pivoting through 180° relative to said first longitudinal position, the decorative elements 20 being capable of adopting any intermediate position between said first and second longitudinal positions, depending on the positioning and the movements of the jewelry. The appearance of the jewelry is then modified not only by exposing different decorative zones 21 and/or 22 of each decorative element 20, but also by the general shape of the piece of jewelry being substantially different depending on the positions of the connection members 40. As shown in FIG. 9*b*, some of the decorative elements 20 may be in the longitudinal position and the remainder may be in the transverse position.

The present invention is described with reference to a plurality of advantageous embodiments, however it should be understood that a person skilled in the art can provide any modifications thereto without going beyond the ambit of the present invention as defined by the accompanying claims.

The invention claimed is:

1. Jewelry, comprising a support base and a plurality of decorative elements, each having at least two different decorative zones, each decorative element being fastened in a frame that is secured to a connection member that is pivotally and/or rotatably mounted on said support base, each decorative zone being oriented differently relative to said frame in such a manner that, depending on the position of each connection member on said support base, a different decorative zone is exposed so as to modify the appearance of the jewelry;

wherein each connection member has one end fastened to said frame and another end pivotally mounted on said support base to pivot about a pivot axis perpendicular to said connection member; and wherein said connection member has two branches, each branch having a first end fastened to said frame and a second end pivotally mounted on a pin forming said pivot axis.

2. The jewelry according to claim 1, wherein said support base is a rigid pin or frame.

3. The jewelry according to claim 1, wherein said support base is a deformable necklace or bracelet.

4. The jewelry according to claim 1, wherein each decorative element has two decorative zones formed by two mutually opposite faces at 180° relative to each other.

5. The jewelry according to claim 1, wherein the decorative zones of each decorative element include decorative gems of different colors.

6. The jewelry according to claim 1, wherein said decorative elements are in alignment one after another so that pivoting or rotating one of said decorative elements gives rise to at least some of the other decorative elements pivoting or rotating.

7. The jewelry according to claim 1, wherein said decorative elements are arranged along and around said support base, being pivotally mounted to pivot between a first longitudinal position in which the decorative elements are arranged in the direction of said support base and a second longitudinal position that is pivoted through 180° relative to said first longitudinal position, said decorative elements being capable of adopting any intermediate position between said first and second longitudinal positions.

8. Jewelry, comprising a support base and a plurality of decorative elements, each having at least two different decorative zones, each decorative element being fastened in a frame that is secured to a connection member itself pivotally and/or rotatably mounted on said support base, each decorative zone being oriented differently relative to said frame in such a manner that, depending on the position of each connection member on said support base, a different decorative zone is exposed so as to modify the appearance of the jewelry;

wherein said jewelry is an earring or a brooch, said support base forming an elongate pin having two attachment points, each attachment point being pivotally fastened on a respective end portion of said support base, thereby enabling the earring or the brooch to be attached in two opposite orientations depending on which attachment point is used.

9. The jewelry according to claim 8, wherein each connection member is made in the form of two pin portions on a common axis arranged on either side of said frame, each pin portion firstly being fastened to said frame and secondly being mounted rotatably on said support base, in such a manner that said connection member forms the axis of rotation of said frame relative to said support base.

10. The jewelry according to claim 9, wherein said axis of rotation is formed in a plane of symmetry of said frame.

11. The jewelry according to claim 8, wherein said support base is a rigid pin.

12. The jewelry according to claim 8, wherein each decorative element has two decorative zones formed by two mutually opposite faces at 180° relative to each other.

13. The jewelry according to claim 8, wherein the decorative zones of each decorative element include decorative gems of different colors.

14. The jewelry according to claim 8, wherein said decorative elements are in alignment one after another so that pivoting or rotating one of said decorative elements gives rise to at least some of the other decorative elements pivoting or rotating.

15. The jewelry according to claim 8, wherein said decorative elements are arranged along and around said support base, being pivotally mounted to pivot between a first longitudinal position in which the decorative elements are arranged in the direction of said support base and a second longitudinal position that is pivoted through 180° relative to said first longitudinal position, said decorative elements being capable of adopting any intermediate position between said first and second longitudinal positions.

* * * * *